US010109134B2

(12) United States Patent
Jeong et al.

(10) Patent No.: US 10,109,134 B2
(45) Date of Patent: Oct. 23, 2018

(54) BANKING AUTOMATION DEVICE FOR BANK TELLER AND METHOD FOR CONTROLLING SAME

(71) Applicant: NAUTILUS HYOSUNG INC., Seoul (KR)

(72) Inventors: Yun Seok Jeong, Gyeonggi-do (KR); Sang Hyun Lee, Incheon (KR); Seok Kim, Seoul (KR); Chul Won Jang, Seoul (KR); Geon-Hyeok Lim, Gyeonggi-do (KR)

(73) Assignee: NAUTILUS HYOSUNG INC., Seoul (KR)

( * ) Notice: Subject to any disclaimer, the term of this patent is extended or adjusted under 35 U.S.C. 154(b) by 0 days.

(21) Appl. No.: 15/551,322

(22) PCT Filed: Feb. 26, 2016

(86) PCT No.: PCT/KR2016/001949
§ 371 (c)(1),
(2) Date: Aug. 16, 2017

(87) PCT Pub. No.: WO2016/137281
PCT Pub. Date: Sep. 1, 2016

(65) Prior Publication Data

US 2018/0040187 A1 Feb. 8, 2018

(30) Foreign Application Priority Data

Feb. 27, 2015 (KR) ..... 10-2015-0028186

(51) Int. Cl.
*G07D 7/00* (2016.01)
*G07D 11/00* (2006.01)
*G07F 19/00* (2006.01)

(52) U.S. Cl.
CPC ..... *G07D 11/0009* (2013.01); *G07D 7/00* (2013.01); *G07D 11/0024* (2013.01);
(Continued)

(58) Field of Classification Search
CPC .. G07D 7/00; G07D 11/0003; G07D 11/0006; G07D 11/0009; G07D 11/0021;
(Continued)

(56) References Cited

U.S. PATENT DOCUMENTS 8,567,585 B2 * 10/2013 Okamura ..... G07D 11/006 194/216
8,689,962 B2 * 4/2014 Mizoro ..... G07D 11/0012 194/206

(Continued)

FOREIGN PATENT DOCUMENTS

IN 4391/DELNP/2013 11/2014
JP 2012-108818 A 6/2012

OTHER PUBLICATIONS

Australian Examination Report dated Jan. 15, 2018 issued in corresponding Australian Patent Application No. 2016224162, (3 pages).

*Primary Examiner* — Mark J Beauchaine
(74) *Attorney, Agent, or Firm* — Bacon & Thomas, PLLC

(57) ABSTRACT

A banking automation device for a bank teller and a method for controlling same are disclosed. A banking automation device for a bank teller according to an embodiment may comprise: a handling part; a vault provided below the handling part and providing space for storing bills; a cassette mounting part provided on the outside of the vault; and a removable cassette selectively mounted on the cassette mounting part to add bills to the vault or collect bills that are stored in the vault.

16 Claims, 6 Drawing Sheets

(52) U.S. Cl.
CPC ..... *G07D 11/0033* (2013.01); *G07D 11/0084* (2013.01); *G07F 19/202* (2013.01)

(58) Field of Classification Search
CPC ..... G07D 11/0051; G07D 11/006; G07D 11/0081; G07F 19/202
See application file for complete search history.

(56) References Cited

U.S. PATENT DOCUMENTS

| | | | | |
|---|---|---|---|---|
| 8,708,127 | B2 * | 4/2014 | Roosch | G07D 11/0081 109/58 |
| 2015/0243119 | A1 * | 8/2015 | Hayashi | G07D 11/0018 194/206 |
| 2016/0196708 | A1 * | 7/2016 | Doi | G06Q 20/10 194/206 |

* cited by examiner

BANKING AUTOMATION DEVICE FOR BANK TELLER AND METHOD FOR CONTROLLING SAME

TECHNICAL FIELD

The present disclosure relates to a teller cash recycler and a control method thereof.

BACKGROUND

Typically, a teller cash recycler may include a handling unit through which bills are received and dispensed by a teller's operation, a safe provided with a storage unit for storing bills, a conveyance unit for conveying bills, a door for selectively opening or closing the safe, and so forth.

In the case of a conventional teller cash recycler, it is inconvenient to operate the door and open the safe each time when the bills stored in the storage unit are discharged to the outside or when the bills are supplemented into the storage unit. In particular, an approval of an interested person of a bank is required to open the safe. Thus, it is necessary to perform a procedure of acquiring an approval of an interested person of a bank each time when the bills are collected or supplemented. This poses a problem in that the operation convenience and the accessibility are impaired.

SUMMARY

Embodiments of the present disclosure provide a teller cash recycler in which a cassette mounting part for mounting a removable cassette that can be connected to the interior of the teller cash recycler is provided outside a door, and a control method thereof.

In accordance with an aspect of the present disclosure, there is provided a teller cash recycler, including: a handling unit including a bill receiving unit, a bill dispensing unit, a main conveyance unit, a discrimination device and at least one switching gate; a safe provided under the handling unit and configured to provide a space for storing bills; a cassette mounting part provided outside the safe; a removable cassette selectively mounted to the cassette mounting part to supplement bills to the safe or collect the bills stored in the safe; and a control unit configured to control an operation of the teller cash recycler.

According to the embodiments of the present disclosure, it is possible to provide a teller cash recycler in which a cassette mounting part for mounting a removable cassette that can be connected to the interior of the teller cash recycler is provided outside a door, and a control method thereof.

DETAILED DESCRIPTION

Figure 1:
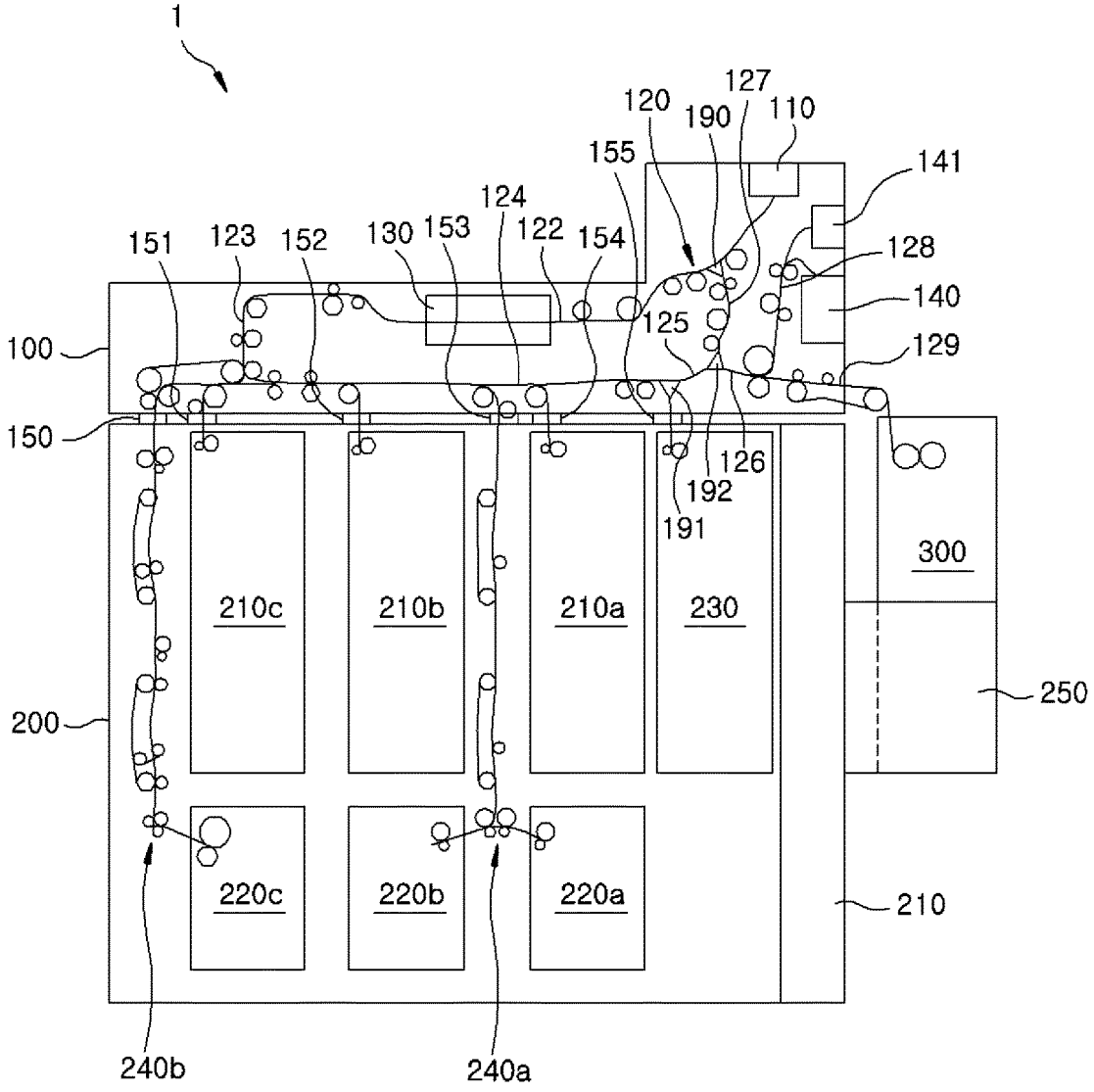
FIG. 1 is a schematic side view of a teller cash recycler according to one embodiment of the present disclosure.

Hereinafter, specific embodiments for realizing the technical idea of the present disclosure will now be described in detail with reference to the accompanying drawings. For reference, the right side in the drawings may be a front side, and the left side in the drawings may be a rear side.

As shown in FIG. 1, the teller cash recycler 1 according to the present embodiment may include a handling unit 100, a safe 200 and a removable cassette 300.

The handling unit 100 may include a bill receiving unit 110, a main conveyance unit 120, a discrimination device 130, and bill dispensing units 140 and 141. A space for storing bills may be provided inside the safe 200. A cassette mounting part 250 may be provided outside a safe door 210. If necessary, a removable cassette 300 may be mounted to the cassette mounting part 250.

The handling unit 100 may be a unit in which bill receiving, bill dispensing and bill counting are performed by a user's operation. To this end, the handling unit 100 may include a bill receiving unit 110 and bill dispensing units 140 and 141. The bill dispensing units 140 and 141 may include a first bill dispensing unit 140 and a second bill dispensing unit 141 which will be described later.

In the present embodiment, the handling unit 100 may include a main conveyance unit 120. The main conveyance unit 120 may include a plurality of conveyance paths 122 to 129. Components such as a belt, a roller, a motor and the like are provided in each of the conveyance paths 122 to 129. Bills may be conveyed along each of the conveyance paths 122 to 129 by the operation of the components.

An upper conveyance path 122 among the conveyance paths 122 to 129 may be positioned on the upper side and may convey bills substantially in the horizontal direction. Both ends of the upper conveyance path 122 may respectively be connected to the bill receiving unit 110 and a first vertical conveyance path 123 which will be described later. One end portion of the upper conveyance path 122 on the side of the bill receiving unit 110 may be connected to a second vertical conveyance path 127 which will be described later. A first switching gate 190 may be provided at the point where the upper conveyance path 122 and the second vertical conveyance path 127 are connected to each other. A bill conveyance path may be set by rotating the first switching gate 190 to switch the posture thereof. In the present embodiment, the first switching gate 190 is a three-way diverter. For example, in a first posture, the first switching gate 190 connects the bill receiving unit 110 and the upper conveyance path 122. In a second posture, the first switching gate 190 connects the second vertical conveyance path 127 and the upper conveyance path 122. A discrimination device 130 to be described later may be provided on the upper conveyance path 122.

The upper end of the first vertical conveyance path 123 may be connected to the upper conveyance path 122. The lower end of the first vertical conveyance path 123 may be connected to lower conveyance paths 124, 125 and 126.

The lower conveyance paths 124, 125 and 126 may be connected to the first vertical conveyance path 123 and may convey bills substantially in the horizontal direction. In the present embodiment, the lower conveyance paths 124, 125 and 126 may include a first section 124, a second section 125 and a third section 126.

In the first section 124, the lower conveyance path 124 may convey bills to and may receive bills from the safe 200 via interfaces 150 to 155 that provide bill conveyance paths. The interfaces 150 to 155 protrude downward from the lower surface of the handling unit 100. The interfaces 150 to 155 are inserted into respective openings (not shown) of the upper surface of the safe 200 and are directly or indirectly connected to cassettes and the like inside the safe 200. Referring to FIG. 1, the interfaces 151, 152, 154 and 155 may be directly connected to cassettes 210*c*, 210*b*, 210*a* and 230 inside the safe 200. The interfaces 150 and 153 may be connected to cassettes 220*c*, 220*b* and 220*a* inside the safe 200 via respective vertical conveyance units 240*b* and 240*a*.

One end of the second section 125 may be connected to the front end of the first section 124. A second switching gate 191 may be provided at the point where the first section 124 and the second section 125 are connected to each other. A bill conveyance path may be set by rotating the second switching gate 191 to switch the posture thereof. In the present embodiment, the second switching gate 191 is a three-way diverter. For example, in a first posture, the second switching gate 191 connects the first section 124 and the second section 125. In a second posture, the second switching gate 191 connects the second section 125 and the interface 155 which is connected to an abnormal bill storage cassette 230. In a third posture, the second switching gate 191 connects the first section 124 and the interface 155 which is connected to the abnormal bill storage cassette 230.

The other end, i.e., the front end of the second section 125 may be connected to the second vertical conveyance path 127 or the third section 126. To this end, a third switching gate 192 may be provided at the point where the second section 125, the second vertical conveyance path 127 and the third section 126 are converged. A bill conveyance path may be set by rotating the third switching gate 192 to switch the posture thereof. In the present embodiment, the third switching gate 192 is a three-way diverter. For example, in a first posture, the third switching gate 192 connects the second section 125 and the third section 126. In a second posture, the third switching gate 192 connects the second vertical conveyance path 127 and the third section 126. In a third posture, the third switching gate 192 connects the second vertical conveyance path 127 and the second section 125.

As described above, one end of the third section 126 may be connected to the second section 125 or the second vertical conveyance path 127. The other end of the third section 126 may be connected to a bill dispensing conveyance path 128 or a supplement/collection conveyance path 129. Although not shown in the drawings, a switching gate may be provided at the point where the third section 126, the bill dispensing conveyance path 128 and the supplement/collection conveyance path 129 are converged.

Both ends of the bill dispensing conveyance path 128 may be connected to the third section 126 of the lower conveyance path and the bill dispensing units 140 and 141. Both ends of the supplement/collection conveyance path 129 may respectively be connected to the third section 126 of the lower conveyance path and the removable cassette 300.

The handling unit 100 may include a discrimination device 130. For example, the discrimination device 130 may be provided on the upper conveyance path 122. The discrimination device 130 may discriminate the abnormality of bills, the type of bills and the like.

As described above, in the present embodiment, the bill dispensing units 140 and 141 may include a first bill dispensing port 140 and a second bill dispensing port 141. In the case of simultaneously using the first bill dispensing port 140 and the second bill dispensing port 141, bills having different characteristics may be discharged through the respective bill dispensing ports 140 and 141. For example, bills determined to be normal may be discharged through the first bill dispensing port 140. Bills determined to be abnormal may be discharged through the second bill dispensing port 141. As another example, among the abnormal bills to be dispensed, bills determined to be counterfeit bills may be discharged through the first bill dispensing port 140, and abnormal bills other than counterfeit bills may be discharged through the second bill dispensing port 141. Needless to say, counterfeit bills may be discharged through the second bill dispensing port 141.

As described above, the handling unit 100 may include not only the bill receiving unit 110 and the bill dispensing units 140 and 141 but also various other components such as the main conveyance unit 120 and the like. In order to perform the maintenance of internal components of the handling unit 100 and the removal of a jammed bill, the handling unit 100 may be designed to be relatively movable with respect to the safe 200.

As shown in the drawings, the safe 200 may be provided under the handling unit 100. The safe 200 may provide a space for storing bills and may protect bills from the access of an unauthorized person. A safe door 210 for selectively opening or closing the safe 200 may be provided on the front side of the safe 200.

A plurality of cassettes for storing different types of bills may be provided inside the safe 200. The cassettes may be provided in different sizes depending on the types of bills and the use frequency thereof. For example, in the case of the present embodiment, three large cassettes 210*a*, 210*b* and 210*c* for storing bills having a relatively high use frequency may be provided and three small cassettes 220*a*, 220*b* and 220*c* for storing bills having a relatively low use frequency may be provided under the large cassettes 210*a*, 210*b* and 210*c*. The bills stored in the large cassettes 210*a*, 210*b* and 210*c* are frequently used. Thus, the large cassettes 210*a*, 210*b* and 210*c* may be directly connected to the interfaces 151, 152 and 154 to shorten the conveyance time thereof. On the other hand, the bills stored in the small cassettes 220*a*, 220*b* and 220*c* are not frequently used. Thus, the small cassettes 220*a*, 220*b* and 220*c* are disposed under the large cassettes 210*a*, 210*b* and 210*c* and may be connected to the interfaces 150 and 153 via the vertical conveyance units 240*a* and 240*b*. This is a cassette arrangement structure provided in consideration of the limit when enlarging the safe 200 in the front-rear direction.

An abnormal bill storage cassette 230 for storing abnormal bills may be provided inside the safe 200. In the present embodiment, the abnormal bill storage cassette 230 is large in size and is positioned adjacent to the safe door 210.

The vertical conveyance units 240*b* and 240*a* may respectively connect the interfaces 150 and 153 and the small cassettes 220*a*, 220*b* and 220*c* disposed on the lower side. The vertical conveyance unit 240*a* may vertically extend between the cassettes spaced apart in the front-rear direction. In this sense, the vertical conveyance unit 240*a* may be referred to as a central conveyance part. In FIG. 1, the lower end of the central conveyance unit 240*a* may be connected to the two cassettes 220*a* and 220*b*. Thus, the central conveyance unit 240*a* may selectively supply bills to one of the cassettes 220*a* and 220*b* or may selectively receive bills from one of the cassettes 220*a* and 220*b*.

Although not shown in the drawings, the vertical conveyance units 240*a* and 240*b* may also be connected to the large cassettes 210*a*, 210*b* and 210*c* disposed on the upper side. For example, the vertical conveyance unit 240*b* at the rear side of the teller cash recycler 1 may be connected to not only the small cassettes 220*c* but also the large cassettes 210*c*.

As described above, the handling unit 100 may be moved relatively with respect to the safe 200 to protrude forward. Similarly, the cassettes existing inside the safe 200 may also be moved relatively with respect to safe 200 to protrude forward. For example, a cart (not shown) for accommodating a plurality of cassettes is provided inside the safe 200. When the safe door 210 is opened, the cart may be moved relatively with respect to the safe 200 to protrude forward. In this state, a user may perform a cassette replacement work, a bill collection work, a bill supplement work, a maintenance work, and the like.

If necessary, the removable cassette 300 may be mounted to the cassette mounting part 250 provided outside the safe door 210. When mounted to the cassette mounting part 250, the removable cassette 300 may be connected to the supplement/collection conveyance path 129 and, therefore, may be connected to the interior of the teller cash recycler 1.

Specifically, the removable cassette 300 mounted to the cassette mounting part 250 may be used for supplementing bills. For example, when there is a need to supplement specific bills to a specific cassette existing inside the safe 200, a user may put specific bills into the removable cassette 300 without operating the safe door 210 to open the safe 200 and may mount the removable cassette 300 to the cassette mounting part 250. The specific bills may be stored in the specific cassette inside the safe 200 via the supplement/collection conveyance path 129.

The removable cassette 300 may be used for collecting bills. For example, when there is a need to collect the bills stored in a specific cassette inside the safe 200, a user may mount the removable cassette 300 to the cassette mounting part 250 and then may cause the bills in the specific cassette to be conveyed to the removable cassette 300. The bills stored in the specific cassette may be put into the removable cassette 300 via the supplement/collection conveyance path 129. This enables the user to perform a bill collection work without operating the safe door 210 to open the safe 200.

If a certain bill is discriminated to be abnormal when dispending bills, such an abnormal bill may be conveyed to the removable cassette 300 rather than the bill dispensing units 140 and 141. This enables the user to easily check and collect an abnormal bill without operating the safe door 210 to open the safe 200 (This holds true in the case of receiving bills).

As described above, by providing the cassette mounting part 250 outside the safe door 210 so that, if necessary, the removable cassette 300 can be mounted to the cassette mounting part 250, a user can conveniently and easily perform various works without operating the safe door 210 to open the safe 200. In particular, it is not necessary to acquire an approval of an interested person of a bank in order to open the safe 200. This makes it possible to greatly improve the operation convenience of the teller cash recycler 1 and the user's accessibility.

Meanwhile, the teller cash recycler 1 according to the present embodiment may include a control unit (not shown). The control unit may refer to a component that governs all the bill conveyance and treatment operations performed in the teller cash recycler 1. For example, the control unit may control the operation of each of the conveyance units 120, 240*a* and 240*b* and may control the operation of each of the switching gates 190 to 192. Furthermore, the control unit may receive information on the characteristics of bills from the discrimination device 130. Based on the information, the control unit may control the operations of the internal components of the teller cash recycler 1 in a predetermined manner. In addition, the control unit may control the operations of the internal components of the teller cash recycler 1 in a preset manner to execute a command received from a user. The internal components of the teller cash recycler 1 may include the removable cassette 300. Thus, the control unit may govern the conveyance and treatment of bills related to the removable cassette 300.

Figure 2:
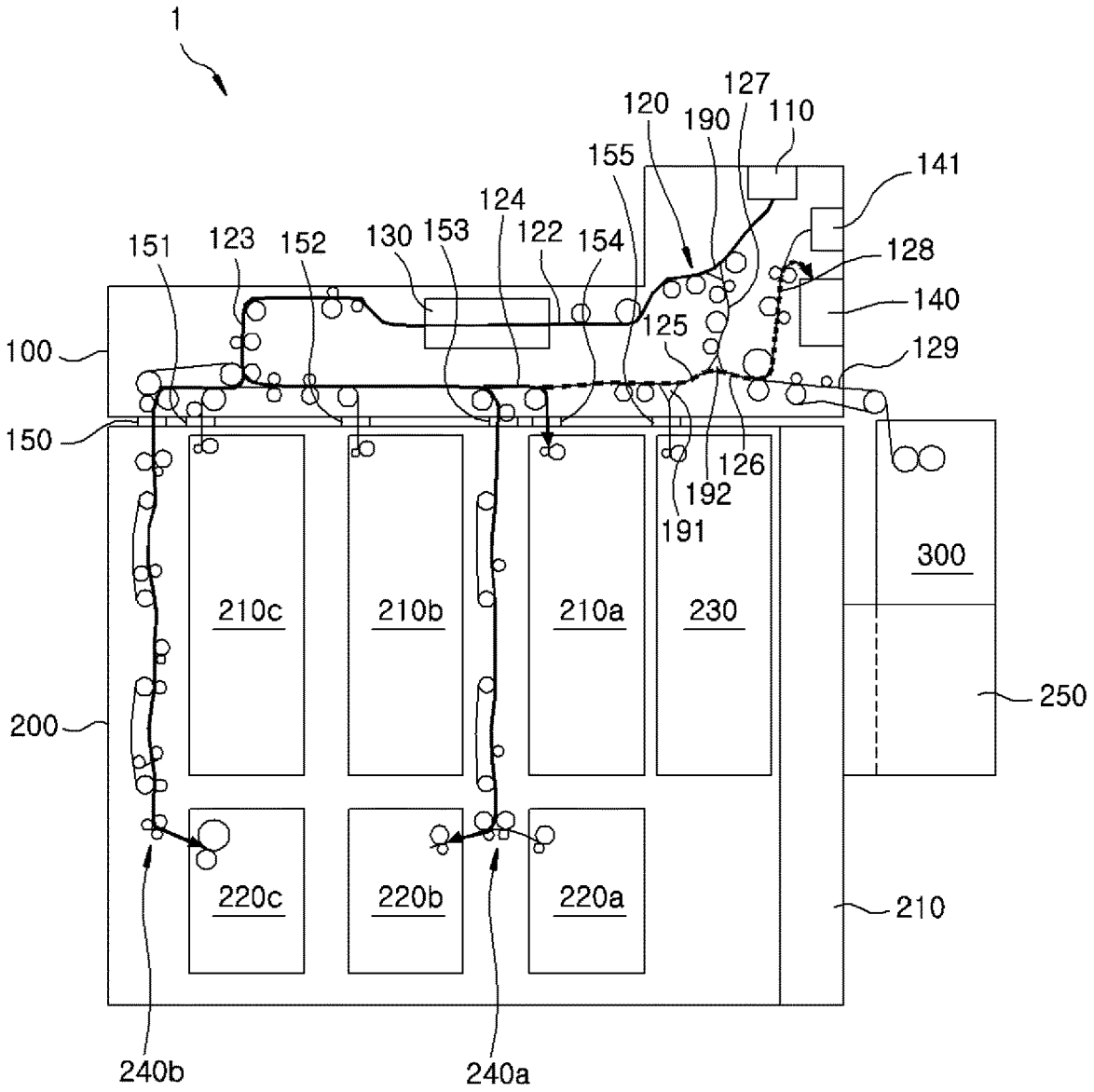
FIG. 2 is a view showing an example of a state in which bills are received by the teller cash recycler shown in FIG. 1.

FIG. 2 is a view showing an example of a state in which bills are received by the teller cash recycler 1 shown in FIG. 1. A bill receiving route is indicated by a thick solid line. A bill rejecting route is indicated by a dotted line.

Bills received through the bill receiving unit 110 may be conveyed into the teller cash recycler 1 along the upper conveyance path 122. At this time, the first switching gate 190 may have the first posture to connect the bill receiving unit 110 and the upper conveyance path 122. The bills may pass through the discrimination device 130 existing on the upper conveyance path 122. The discrimination device 130 may discriminate the abnormality of bills and the type of bills. If the bills are discriminated to be normal, the bills may be stored in the cassette conforming to the type of the bills. For example, as shown in FIG. 2, the bills may be stored in the small cassette 220*c* on the lower side after passing through the first vertical conveyance path 123 and the vertical conveyance part 240*b*. Alternatively, the bills may be stored on the small cassette 220*b* in the lower side after passing through the first vertical conveyance path 123, the lower conveyance path 124 and the vertical conveyance part 240*a*. Alternatively, the bills may be stored in the large cassette 210*a* on the upper side of the safe 200 after passing through the first vertical conveyance path 123 and the lower conveyance path 124. On the other hand, if the bills are discriminated to be abnormal, as indicated by the dotted line, the bills may be returned to a user through the first bill dispensing port 140 after passing through the first vertical conveyance path 123, the lower conveyance paths 124, 125 and 126 and the bill dispensing conveyance path 128. At this time, the second switching gate 191 may have the first posture to connect the first section 124 and the second section 125, and the third switching gate 192 may have the first posture to connect the second section 125 and the third section 126.

Figure 3:
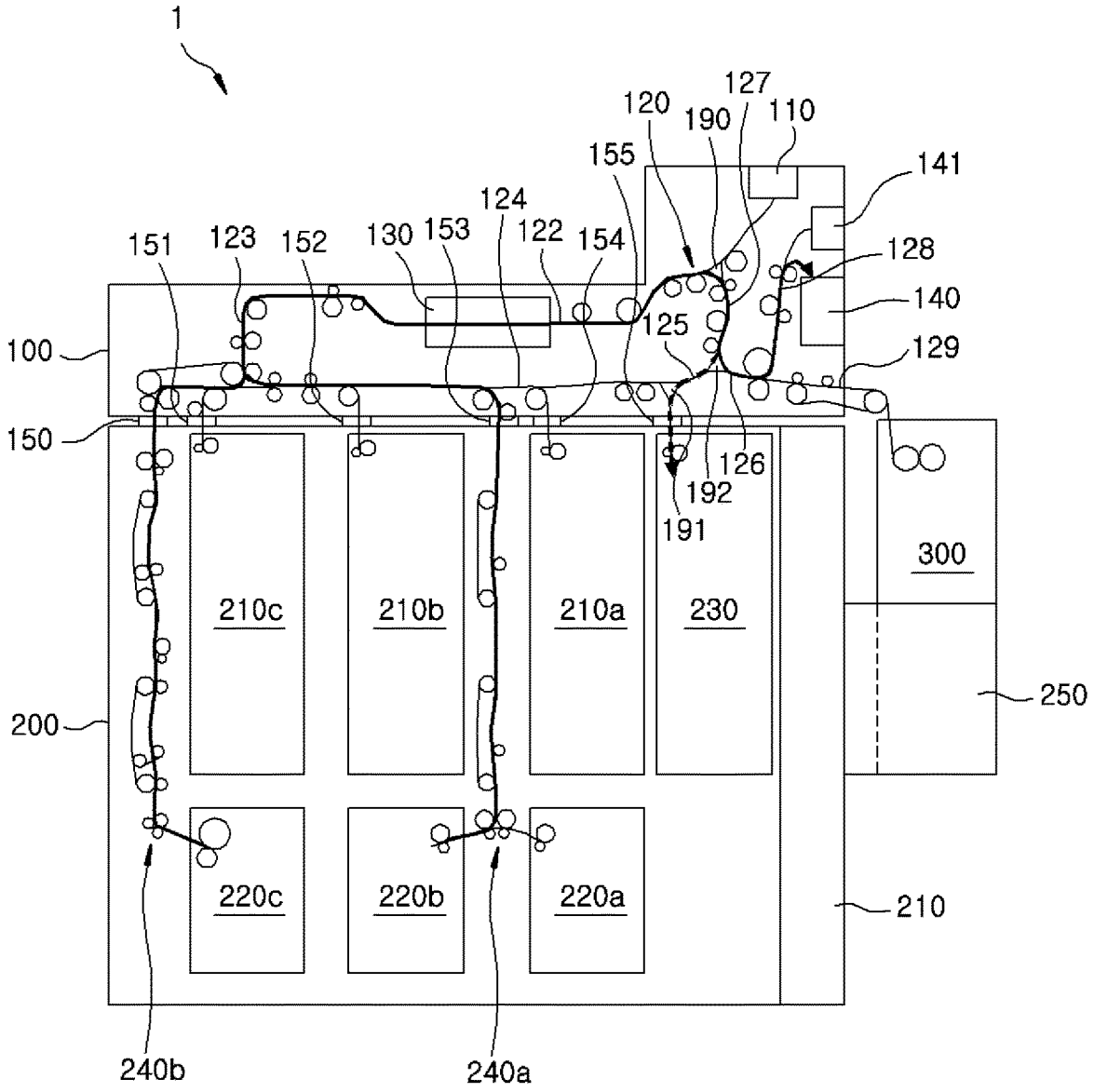
FIG. 3 is a view showing an example of a state in which bills are dispensed from the teller cash recycler shown in FIG. 1.

FIG. 3 is a view showing an example of a state in which bills are dispensed from the teller cash recycler 1 shown in FIG. 1. A bill dispensing route is indicated by a thick solid line. A bill rejecting route is indicated by a dotted line.

For example, the bills stored in the small cassette 220*b* on the lower side may be conveyed along the vertical conveyance part 240*a*, the lower conveyance path 124, the first vertical conveyance path 123 and the upper conveyance path 122. If the bills passing through the discrimination device 130 are discriminated to be normal, the bills may be discharged to the first bill dispensing port 140 through the second vertical conveyance path 127, the lower conveyance path 126 and the bill dispensing conveyance path 128. Furthermore, the bills stored in the small cassette 220*c* on the lower side may be conveyed along the vertical conveyance part 240*b*, the first vertical conveyance path 123 and the upper conveyance path 122. If the bills passing through the discrimination device 130 are discriminated to be normal, the bills may be discharged to the first bill dispensing port 140 through the second vertical conveyance path 127, the lower conveyance path 126 and the bill dispensing conveyance path 128. At this time, the first switching gate 190 may have the second posture to connect the upper conveyance path 122 and the second vertical conveyance path 127, and the third switching gate 192 may have the second posture to connect the second vertical conveyance path 127 and the third section 126. If the bills are discriminated to be abnormal, the bills may be conveyed along the second vertical conveyance path 127 and may be conveyed to the second section 125 rather than the third section 126. Thereafter, the bills may be stored in the abnormal bill storage cassette 230. At this time, the third switching gate 192 may have the third posture to connect the second vertical conveyance path 127 and the second section 125, and the second switching gate 191 may have the second posture to connect the second section 125 and the interface 155 connected to the abnormal bill storage cassette 230.

Figure 4:
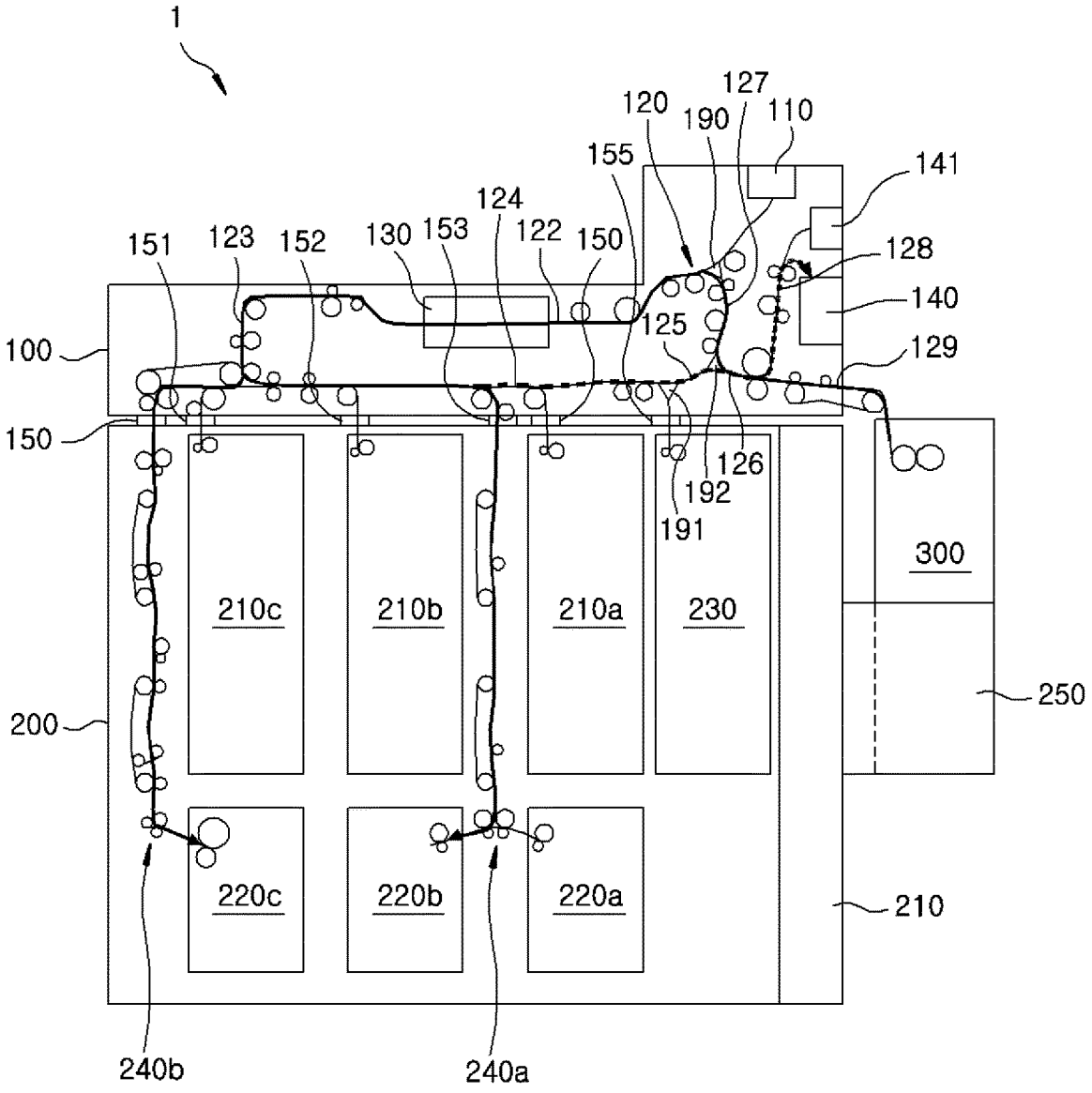
FIG. 4 is a view showing an example of a state in which bills are supplemented to the teller cash recycler shown in FIG. 1.

FIG. 4 is a view showing an example of a state in which bills are supplemented to the teller cash recycler 1 shown in FIG. 1. A bill supplementing route is indicated by a thick solid line. A bill rejecting route is indicated by a dotted line.

A user may load one or more types of bills in the removable cassette 300 and may mount the removable cassette 300 to the cassette mounting part 250. If a supplementing work is started, the bills may be conveyed from the removable cassette 300 along the supplement/collection conveyance path 129, the third section 126, the second vertical conveyance path 127 and the upper conveyance path 122. At this time, the third switching gate 192 may have the second posture to connect the second vertical conveyance path 127 and the third section 126, and the first switching gate 190 may have the second posture to connect the upper conveyance path 122 and the second vertical conveyance path 127. If the bills passing through the discrimination device 130 are determined to be normal, the bills may be stored in the cassette existing inside the safe 200 (e.g., the small cassettes 220*b* and 220*c* shown in FIG. 4). If the bills are discriminated to be abnormal, the bills may be discharged to the first bill dispensing port 140 through the first vertical conveyance path 123, the lower conveyance paths 124, 125 and 126 and the bill dispensing conveyance path 128. At this time, the second switching gate 191 may have the first posture to connect the first section 124 and the second section 125, and the third switching gate 192 may have the first posture to connect the second section 125 and the third section 126. In addition, if the bills are discriminated to be counterfeit bills, the counterfeit bills may be discharged to the second bill dispensing port 141. In this case, the abnormal bills other than the counterfeit bills may be discharged to the first bill dispensing port 140.

In addition, when the bills are discriminated to be abnormal, the operation of discharging the bills stored in the removable cassette 300 may be interrupted. After completing the treatment (e.g., dispensing) of the bills discriminated to be abnormal, the operation of discharging the bills stored in the removable cassette 300 may be resumed. Otherwise, the bills discriminated to be abnormal and the bills newly discharged from the removable cassette 300 may collide with each other in the third section 126 of the lower conveyance paths.

Figure 5:
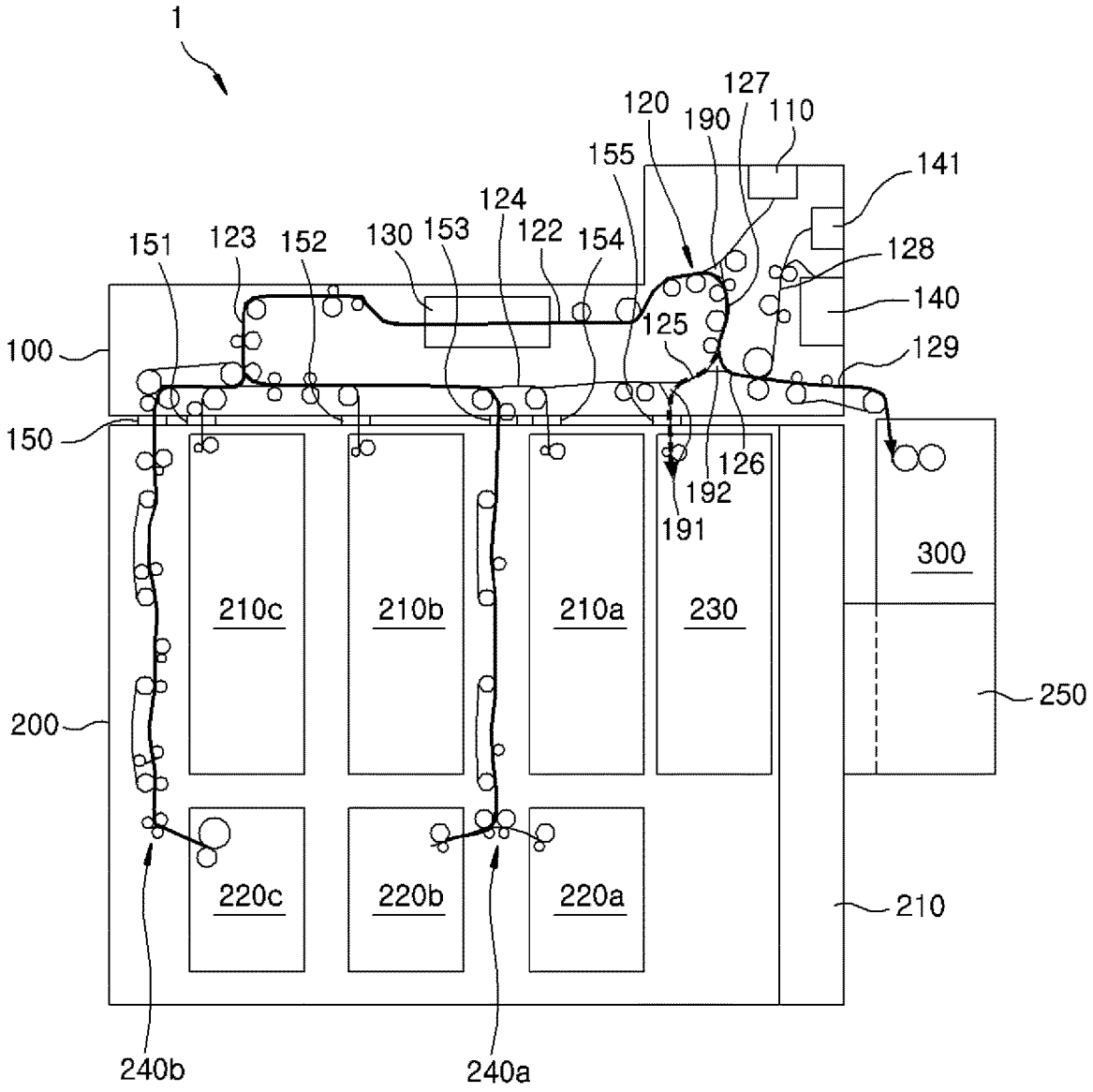
FIG. 5 is a view showing an example of a state in which bills are collected from the teller cash recycler shown in FIG. 1.

FIG. 5 is a view showing an example of a state in which bills are collected from the teller cash recycler 1 shown in FIG. 1. A bill collecting route is indicated by a thick solid line. A bill rejecting route is indicated by a dotted line.

A user may mount the removable cassette 300 to the cassette mounting part 250. If a collection work is started, the bills stored in the small cassette 220*b* on the lower side may be conveyed along the vertical conveyance unit 240*a*, the lower conveyance path 124, the first vertical conveyance path 123 and the upper conveyance path 122. The bills stored in the small cassette 220*c* on the lower side may be conveyed along the vertical conveyance unit 240*b*, the first vertical conveyance path 123 and the upper conveyance path 122. If the bills passing through the discrimination device 130 on the upper conveyance path 122 are discriminated to be normal, the bills may be collected to the removable cassette 300 through the second vertical conveyance path 127, the third section 126 and the supplement/collection conveyance path 129. At this time, the first switching gate 190 may have the second posture to connect the upper conveyance path 122 and the second vertical conveyance path 127. The third switching gate 192 may have the second posture to connect the second vertical conveyance path 127 and the third section 126. If the bills are discriminated to be abnormal, the bills conveyed along the second vertical conveyance path 127 may be guided to the second section 125 rather than the third section 126 and then may be stored in the abnormal bill storage cassette 230. At this time, the third switching gate 192 may have the third posture to connect the second vertical conveyance path 127 and the second section 125. The second switching gate 191 may have the second posture to connect the second section 125 and the interface 155 connected to the abnormal bill storage cassette 230.

Figure 6:
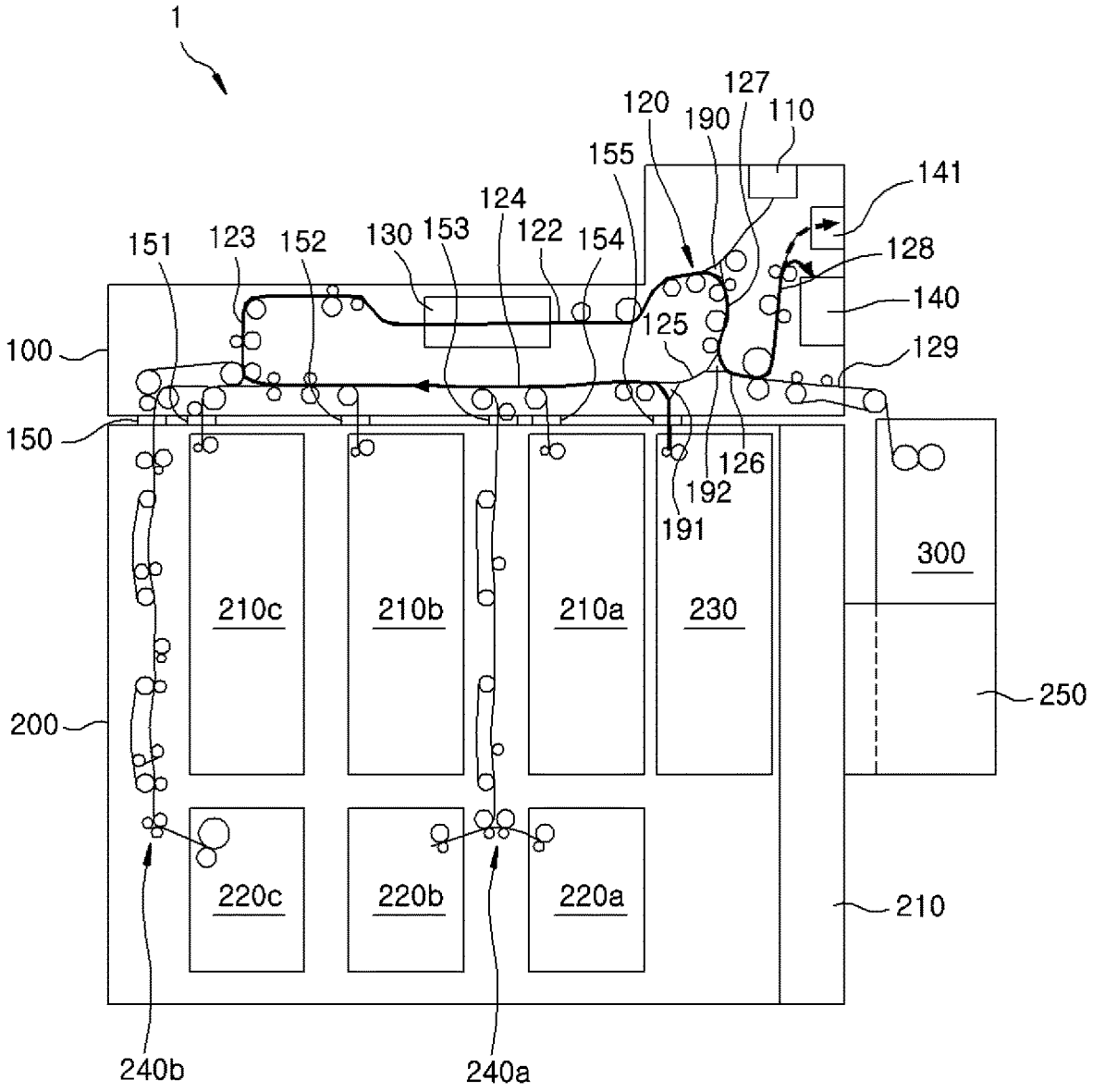
FIG. 6 is a view showing an example of a state in which bills stored in an abnormal bill storage cassette are discharged from the teller cash recycler shown in FIG. 1.

FIG. 6 is a view showing an example of a state in which bills stored in the abnormal bill storage cassette 230 are discharged from the teller cash recycler shown in FIG. 1. When the second switching gate 191 has the third posture to connect the first section 124 and the interface 155 connected to the abnormal bill storage cassette 230, the bills stored in the abnormal bill storage cassette 230 may be conveyed along the first section 124 of the lower conveyance paths, the first vertical conveyance path 123, and the upper conveyance path 122. The bills pass through the discrimination device 130 on the upper conveyance path 122. Then, the bills may be discharged to the bill dispensing units 140 and 141 via the second vertical conveyance path 127, the third section 126 and the bill dispensing conveyance path 128. At this time, the first switching gate 190 may have the second posture to connect the upper conveyance path 122 and the second vertical conveyance path 127. The third switching gate 192 may have the second posture to connect the second vertical conveyance path 127 and the third section 126. If the bills are normal, the bills may be discharged to the first bill dispensing port 140. If the bills are abnormal, the bills may be discharged to the second bill dispensing port 141 as indicated by a dotted line.

What is claimed is:

1. A teller cash recycler, comprising:

a handling unit including a bill receiving unit, a bill dispensing unit, a main conveyance unit, a discrimination device and at least one switching gate;

a safe provided under the handling unit and configured to provide a space for storing bills;

a cassette mounting part provided outside the safe;

a removable cassette selectively mounted to the cassette mounting part to supplement bills to the safe or collect the bills stored in the safe;

a control unit configured to control an operation of the teller cash recycler;

a plurality of cassettes provided inside the safe and configured to store bills, wherein the plurality of cassettes include a plurality of first cassettes having a first size, and a plurality of second cassettes having a second size smaller than the first size;

at least one vertical conveyance unit having an upper end connected to the main conveyance unit and a lower end connected to the second cassettes; and a plurality of interfaces configured to provide conveyance routes between the handling unit and the safe, each of the interfaces having an upper end connected to the main conveyance unit and a lower end extending downward from the handling unit and inserted into the safe, wherein the bills stored in the removable cassette are conveyed between the handling unit and the second cassette through at least one of the interfaces and said at least one vertical conveyance unit.

2. The teller cash recycler of claim 1, wherein the first cassettes are disposed at an upper side in the safe in a spaced-apart relationship in a front-rear direction, and the second cassettes are disposed at a lower side in the safe in a spaced-apart relationship in the front-rear direction.

3. The teller cash recycler of claim 2, wherein the plurality of interfaces include additional interfaces configured to provide conveyance routes between the handling unit and the first cassettes, each of the additional interfaces having an upper end connected to the main conveyance unit and a lower end extending downward from the handling unit and directly connected to the corresponding first cassette.

4. The teller cash recycler of claim 1, wherein the main conveyance unit includes:

an upper conveyance path selectively connected to the bill receiving unit;

a first vertical conveyance path extending downward from an end of the upper conveyance path opposite to the bill receiving unit;

a lower conveyance path connected to a lower end of the first vertical conveyance path;

a second vertical conveyance path having an upper end selectively connected to a bill-receiving-unit side portion of the upper conveyance path and a lower end selectively connected to the lower conveyance path;

a bill dispensing conveyance path having one end selectively connected to a bill-dispensing-unit side end of the lower conveyance path and the other end connected to the bill dispensing unit; and a supplement/collection conveyance path having one end selectively connected to the bill-dispensing-unit side end of the lower conveyance path and the other end connected to the removable cassette when the removable cassette is mounted to the cassette mounting part.

5. The teller cash recycler of claim 4, further comprising:

a first switching gate configured to have a first posture in which the first switching gate connects the bill receiving unit and the upper conveyance path, and a second posture in which the first switching gate connects the upper conveyance path and the second vertical conveyance path.

6. The teller cash recycler of claim 4, wherein the lower conveyance path includes:

a first section extending from the lower end of the first vertical conveyance path;

a second section having one end selectively connected to the first section and the other end selectively connected to the second vertical conveyance path; and a third section having one end selectively connected to one of the second section and the second vertical conveyance path, and the other end selectively connected to one of the bill dispensing conveyance path and the supplement/collection conveyance path.

7. The teller cash recycler of claim 6, wherein the bills are conveyed between the handling unit and the safe in the first section.

8. The teller cash recycler of claim 6, further comprising:

an abnormal bill storage cassette provided inside the safe and configured to store abnormal bills; and a second switching gate configured to have a first posture in which the second switching gate connects the first section and the second section, a second posture in which the second switching gate connects the second section and the abnormal bill storage cassette, and a third posture in which the second switching gate connects the first section and the abnormal bill storage cassette.

9. The teller cash recycler of claim 6, further comprising:

a third switching gate configured to have a first posture in which the third switching gate connects the second section and the third section, a second posture in which the third switching gate connects the second vertical conveyance path and the third section, and a third posture in which the third switching gate connects the second vertical conveyance path and the second section.

10. The teller cash recycler of claim 6, wherein when supplementing the bills from the removable cassette into the safe, the control unit connects the supplement/collection conveyance path and the third section, connects the third section and the second vertical conveyance path, and connects the second vertical conveyance path and the upper conveyance path.

11. The teller cash recycler of claim 10, wherein when the bills supplemented into the safe are discriminated to be abnormal, the control unit connects the first section and the second section, connects the second section and the third section, and connects the third section and the bill dispensing conveyance path, so that the abnormal bills are discharged to the bill dispensing unit.

12. The teller cash recycler of claim 11, wherein the control unit is configured to interrupt discharge of the bills from the removable cassette.

13. The teller cash recycler of claim 12, wherein the control unit is configured to resume the discharge of the bills stored in the removable cassette after the abnormal bills are discharged to the bill dispensing unit.

14. The teller cash recycler of claim 11, wherein the bill dispensing unit includes a first bill dispensing port and a second bill dispensing port, and the control unit is configured to discharge the abnormal bills to the first bill dispensing port if the abnormal bills are not counterfeit bills, and discharge the abnormal bills to the second bill dispensing port if the abnormal bills are counterfeit bills.

15. The teller cash recycler of claim 1, wherein the teller cash recycler performs a method comprising:

discharging the bills from the removable cassette mounted to the cassette mounting part;

conveying the bills to the discrimination device;

discriminating abnormality of the bills by the discrimination device; and conveying the bills to the safe and storing the bills in the safe if the bills are normal, and returning the bills to a user if the bills are abnormal.

16. The teller cash recycler of claim 15, wherein the method further comprises:

interrupting discharge of the bills from the removable cassette when abnormal bills are found;

detecting whether the abnormal bills have been returned to the user; and resuming the discharge of the bills from the removable cassette when the abnormal bills have been returned to the user.

* * * * *